US005129383A

United States Patent [19]

Rutten

[11] Patent Number: 5,129,383

[45] Date of Patent: Jul. 14, 1992

[54] LOADING MECHANISM FOR WEAPONS

[76] Inventor: Jean Rutten, Chemin des Minières 1, 4950 Beaufays, Belgium

[21] Appl. No.: 466,933

[22] Filed: Jan. 18, 1990

[30] Foreign Application Priority Data

Jan. 19, 1989 [BE] Belgium ..... 8900058

[51] Int. Cl.[5] ..... F41B 11/00

[52] U.S. Cl. ..... 124/67; 124/66; 124/32

[58] Field of Search ..... 124/67, 66, 32, 56, 124/65, 68

[56] References Cited

U.S. PATENT DOCUMENTS

| | | | |
|---|---|---|---|
| 1,869,600 | 8/1932 | Loomis | 124/67 |
| 2,180,751 | 11/1939 | Wagner . | |
| 2,814,041 | 11/1957 | Haley | 124/65 X |
| 2,834,332 | 5/1958 | Guthrie | 124/67 X |
| 3,198,075 | 8/1965 | Maillard . | |
| 3,906,662 | 9/1975 | Suzuki et al. | 124/66 X |
| 4,870,945 | 10/1989 | Hutchison | 124/68 |
| 4,899,717 | 2/1990 | Rutten et al. . | |

FOREIGN PATENT DOCUMENTS

| | | | |
|---|---|---|---|
| 905904 | 4/1987 | Belgium . | |
| 2313631 | 10/1974 | Fed. Rep. of Germany | 124/67 |

*Primary Examiner*—Peter M. Cuomo
*Attorney, Agent, or Firm*—Foley & Lardner

[57] ABSTRACT

Improved loading mechanism for weapons which principally consists of a piston (15), driven by a spring (16) and an electric driving motor (4) with reduction gear, characterized in that the spring (16) is compressed by the piston (15) of which the compression movement which results in putting the aforementioned spring (16) under tension is controlled by the piston (15) working together with a continuous traction device.

7 Claims, 2 Drawing Sheets

LOADING MECHANISM FOR WEAPONS

BACKGROUND OF THE INVENTION

1. Field of the Invention

This invention relates to an automatic loading mechanism for weapons, of the type in which a spring must be put under tension for firing a shot. In a particular embodiment, this mechanism will be utilized on air rifles.

2. Brief Description of the Related Art

Automatic loading mechanisms for weapons are already known, in which an electric motor implements the tension of a spring, which is necessary for firing a shot. This is described in the Belgian patent application no. 905.904, in which an electric motor, a battery, a reduction gear and a motor mechanism implement the tension of a spring for driving a piston in order to be able to compress air to a high pressure.

This known loading mechanism consists of an electric motor which drives a threaded rod, and a non-rotating nut, which can nevertheless be displaced axially, mounted on this rod and provided with a hammer, which hooks behind a piston, or a part connected to this piston in order to move it with a turning movement of the rod.

This prior mechanism has the disadvantage, however, that the nut must continually effect a to and fro movement in order to region its initial position after the loading of the shot therefore the replacement of the nut is an action which requires energy and time.

Another disadvantage of this known mechanism is that a motor capable of driving in both directions must be provided. To achieve case end switches must be utilized which increase the cost price of the control mechanism.

OBJECTS AND SUMMARY OF THE INVENTION

The present invention relates to a loading mechanism for weapons which utilizes a double action loading system can immediately effect a new loading action without having to effect a return action beforehand.

The improved loading mechanism of the present invention for weapons comprises a piston drive by a spring and an electric motor with reduction gear, characterized in that the spring is compressed by the piston where the recoil displacement which has the result that the tension of the aforementioned spring is controlled by the piston working together with a continuous traction device.

The traction device, in a red embodiment is comprised by a a continuous chain, driven and supported by toothed wheels. This chain is preferably provided with two protruding shafts, on two opposite locations which, alternatively, continually return to the same start and stop positions whether or not a loading operation is effected.

In this manner an unnecessary return action of the traction device will be avoided which will considerably increase the efficiency regarding time and energy. Since less energy is used by the loading mechanism the more loading actions may be effected with the same charge contained in the portable battery, or for an equal number of loading actions a smaller and lighter battery may be utilized. The use of a smaller and lights battery is especially important with weapons, because a light construction is preferred.

Instead of two protruding parts or shafts, the traction device may be provided with several such parts or shafts. Other sources of energy may replace the electrical sources. For example, a manual system could be envisaged utilizing a small crank installed on the side of the rifle.

It is also known that, when a spring is put under tension more energy is necessary the more the end of the stroke of the spring is approached which, among others, results in an increase of forces which, certainly in relation to the average force applied, will lead to an over dimensioning of the materials and motor.

An additional advantage of the present invention is that a hook shaped element capable of being pulled by a shaft, preferably provided on a continuous chain, is connected to the piston, so that when the spring is practically at the end of its tension stroke, i.e. it is in its compressed position the shaft positions itself exactly there where it will describe a circular path. Consequently, this shaft, during the first 90 degrees of the circular path described, will have a horizontal component of velocity from the initial (0 degrees) until zero (90 degrees). This component of velocity can be calculated for each position by multiplying the initial horizontal component of velocity with the sine of the angle in which the shaft is situated. It is clear that the horizontal component of velocity will have a sinusoidal progression.

The motor, while putting the spring under tension, practically at the end of the tension stroke, will simultaneously compress the spring over a shorter distance, and therefore have to develop less power than, for example, in an ordinary linear system. This just at the moment where the compression of the aforementioned spring requires the greatest power. The torque, effected by the motor, will decrease according to a similar sinusoidal progression.

With the traction device of the present invention, the over dimensioning, required with linear traction devices is no longer necessary and an economy both in material and in motor can be realized.

It is equally evident that instead of a chain other endless elements, such as a cable, a toothed belt with protuberances, a band or similar means be utilized.

BRIEF DESCRIPTION OF THE DRAWINGS

This objects, advantages and features of present invention described above will be more fully understood when considered in conjunction with the accompanying drawings in which.

DETAILED DESCRIPTION OF THE PREFERRED EMBODIMENT

In order to better show the characteristics of the loading mechanism for weapons of the present invention, a preferred embodiment is described hereafter, with reference to the accompanying drawings.

Figure 1:
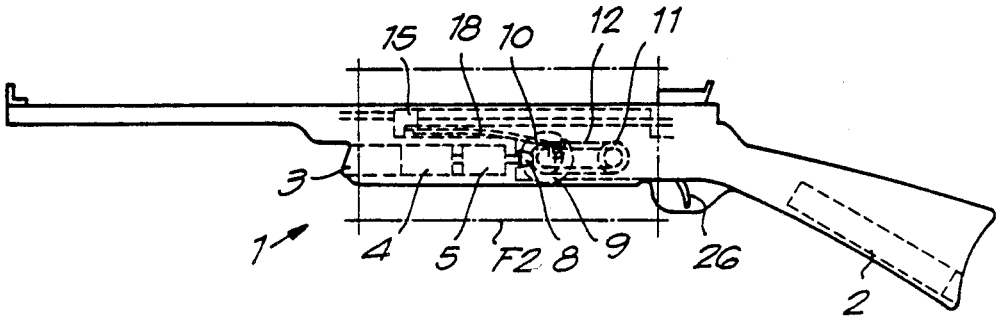
FIG. 1, shows a weapon on which the loading mechanism is applied.

FIG. 1 shows a weapon, in this case an air rifle, in which the improved mechanism is indicated by the block marked F2 and in which the energy for this loading mechanism is, for example, supplied by a battery 2 installed in the butt.

Figure 2:
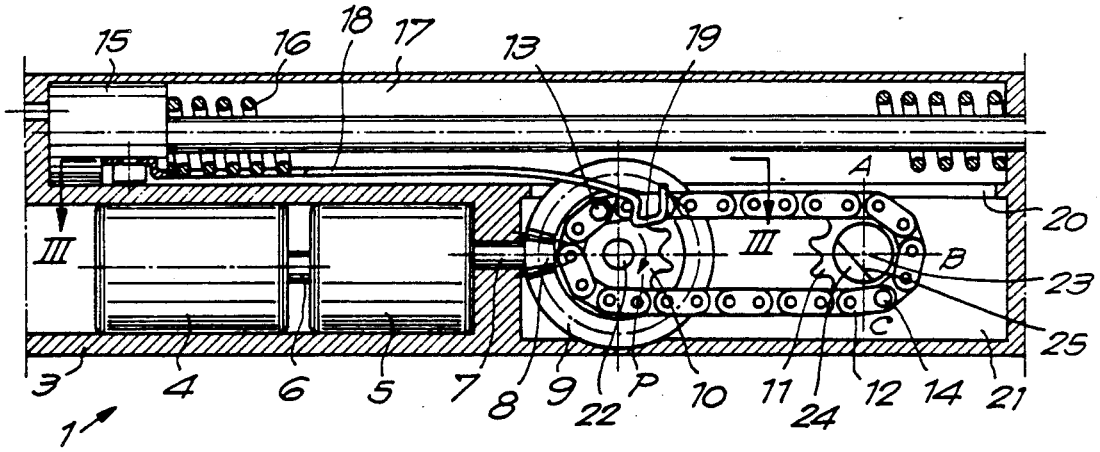
FIG. 2 shows on a larger scale and in cross-section that which is indicated by F2 in FIG. 1.
Figure 3:
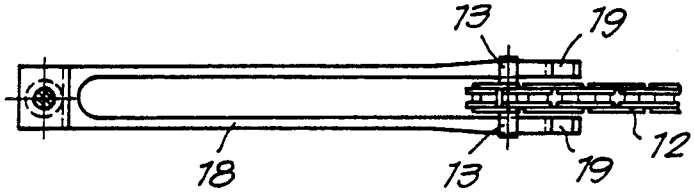
FIG. 3 shows a view according to line III—III in FIG. 2.

In FIG. 2, the motor 4 and the reduction gear 5 are shown in a schematic manner, mounted in the housing 3. The motor 4 produces a rotative movement transmitted to the reduction gear 5 by means of a shaft 6. The reduction gear then transmits the rotative movement by means of the shaft 7 provided with a bevel gear 8 which can work together with a second bevel gear 9 on which an additional chain wheel 10 is provided. Chain wheel 10 is connected to a similar chain wheel 11 by means of a chain 12, on which two protruding shafts 13–14 are provided in this case.

The toothed wheels and chain wheels 9, 10 and 11 are mounted on the shafts which are mounted on bearings that rotate freely in the housing 3.

A piston 15 with drive spring 16 is provided and installed in a chamber 17 around a rod. A supple forked element 18 made for example of spring steel, which is curved downward and has a hook shaped fold 19 at its free extremity, is also provided on piston 15.

The element 18 extends, through a groove 20, into the chamber 21 where the control mechanism is located.

The toothed wheel 9 and a chain wheel 10 are located on a shaft 22 while the chain wheel 11 is located on the shaft 23. The parts of the shaft 23 next to the chain 12, that is, the parts of the shaft 23 which can be under the arms of the element 18 at a determined moment, are only constituted by a segment 24, the purpose of which will be described below.

The operation of the loading mechanism according to the invention is very simple and is described below.

In the resting position the loading mechanism is in position, as shown in FIG. 2. By the control of an electric switch not shown in the drawings, the motor 4 can be provided with current. When the motor rotates, the chain wheel 10 will drive the chain, through suitable means of transmission 6 to 9, accordion to arrow P. The protruding shaft 13 will engage the hook shaped fold 19 of the element of at a determined moment and, as a result, pull along element 18.

In this manner the piston 15, to which the element 18 is attached, will also be pulled along and will compress the spring 16. The shaft 13 will then continue to effect a horizontal rectilinear movement until the chain wheel 11 reaches the position A. From position A, the shaft 13 will deviate from its initial horizontal rectilinear movement and start a circular movement from position A until position C is reached. In this manner, the original horizontal component of movement while in position A, will be partially converted between positions A and C, into a vertical movement.

Between positions A and B, the horizontal component of movement can be calculated by multiplying the initial horizontal component of movement in position A with the sine of the angle formed by the shaft 13 in relation to the shaft of the chain wheel 11 (A=0 degrees and B=90 degrees).

In the position B, spring is completely compressed and the piston 15 will be able to be locked by a suitable locking not shown.

Figure 4:
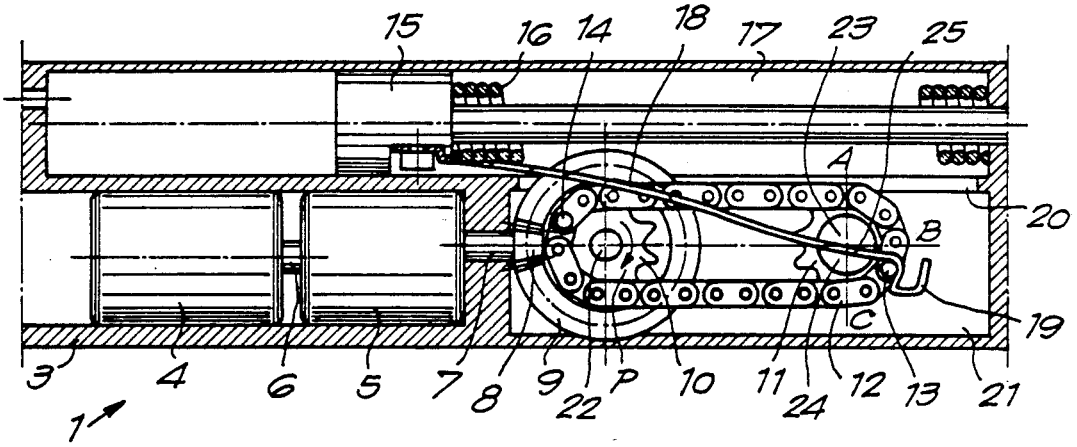
FIG. 4 and 5 show similar views to those from FIG. 2 but in which the traction device has practically terminated the loading action, respectively where the weapon is ready to be fired.

The chain 12 will pull along the shafts 13 until a position, as shown in FIG. 4, following which the hook 19 is released from the shafts in order that the element 18 returns toward the segments 24, more especially their edges 25 also act on this element 18 in order to ensure its release in relation to the shafts 13. From this moment the motor will cease to rotate. This can be applied by the installation of an end switch not shown in the drawings at a suitable location and driven either by the chain 12, or by the element 18.

The unlocking of the piston 15 will be possible afterward, for example, by a release mechanism also not shown which can be controlled from the trigger 22.

During the loading action described above, the shaft 13 has been placed at the position of the shaft 14 in FIG. 2 and the shaft 14 has taken the starting position of the shaft 13 in order to be ready to effect a new loading.

Figure 5:
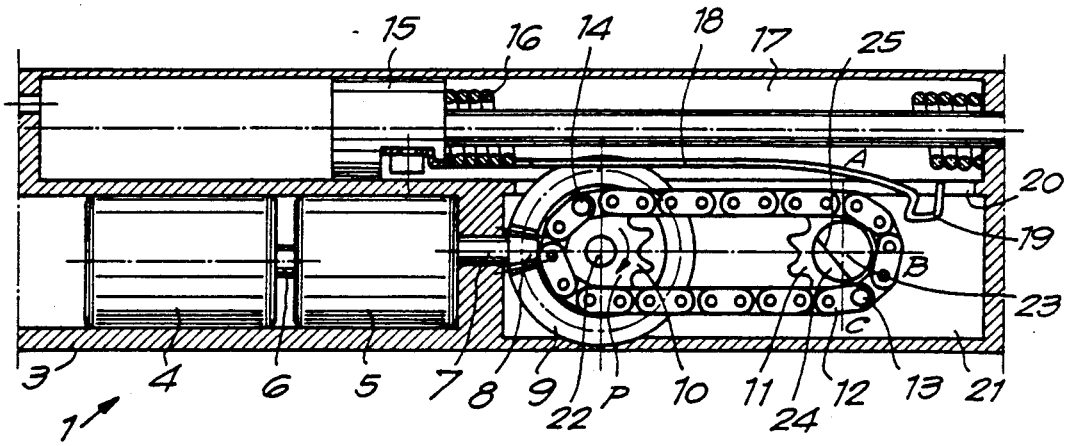

FIG. 5 shows the loaded position which, after a command to fire, will change to be take the position as shown in FIG. 2, with this difference nevertheless that, now, the shafts 13 and 14 have changed place.

The embodiment described above is a system which is especially applicable for air rifles. It is obvious that this improved loading mechanism can be also be used on other types of weapons and for other purposes.

The above description and accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. A loading mechanism for weapons, comprising:
a piston;
a spring for driving the piston;
an electric motor having a reduction gear thereon;
a continuous traction means including a closed loop endless element;
means connected to the traction means for reciprocating the piston to place tension on the spring upon movement of the closed loop endless element;
wherein the traction device comprises the closed loop endless element driven and supported by a plurality of wheels;
wherein a pair of protuberances are mounted at opposite points of the closed loop endless element, said protuberances engaging with said reciprocating means;
wherein the reciprocating means comprises a hook element having one end connected to the piston and the other end cooperating with the protuberances; and
wherein the hook element is attached to the piston and is fork-shaped at its free extremity, such that the fork-shaped extremity folds around the closed loop endless element and grasps the protuberances.

2. A loading mechanism for weapons according to claim 1, wherein the hook element is located under the spring and above the closed loop endless element.

3. A loading mechanism according to claim 1, wherein a locking device is connected to the piston for retaining the piston, when the spring is under tension, in its rear position, the locking device being connected to a trigger.

4. A loading mechanism for weapons according to claim 1, wherein current can be sent to the motor by means of a switch after a shot has been fired, that is after the spring is released when a second end switch is depressed.

5. A loading mechanisms for weapons, comprising:
a piston;
a spring for driving the piston;
an electric motor having a reduction gear thereon;
a continuous traction means including a closed loop endless chain having at least one protuberance connected thereto, the endless chain being driven in a single direction by the reduction gear and being driven and supported by a plurality of chain wheels; and
means connected to the traction means for reciprocating the piston to place tension on the spring upon movement of the closed loop endless chain, wherein said at least one protuberance engages the reciprocating means.

6. A loading mechanism for weapons according to claim 5, wherein an output shaft of the reduction gear is provided with a bevel gear which meshes permanently with a second bevel gear on a respective one of the plurality of chains wheels.

7. A loading mechanism for weapons according to claim 5, further comprising a first protuberance and a second protuberance which are mounted on the closed loop endless chain.

* * * * *